United States Patent [19]

Flegel et al.

[11] Patent Number: 4,766,331

[45] Date of Patent: Aug. 23, 1988

[54] TIMER SWITCH WITH AUXILIARY ACTUATOR

[75] Inventors: David D. Flegel; Dean F. Flegel, both of Racine, Wis.

[73] Assignee: Reliance Time Controls, Inc., Racine, Wis.

[21] Appl. No.: 98,393

[22] Filed: Sep. 18, 1987

[51] Int. Cl.[4] ..... H01H 43/00; H05B 37/02

[52] U.S. Cl. ..... 307/141; 315/159

[58] Field of Search ..... 307/140, 141; 315/159; 200/38 R, 38 B

[56] References Cited

U.S. PATENT DOCUMENTS

| | | | |
|---|---|---|---|
| 2,905,239 | 9/1959 | Dietz | 307/141 |
| 3,135,908 | 6/1964 | Harris | 318/476 |
| 3,156,851 | 11/1964 | Monday | 317/157 |
| 3,350,606 | 10/1967 | Hirsch | 317/22 |
| 3,368,048 | 2/1968 | Berger | 200/136.3 |
| 3,465,110 | 9/1969 | Marcel et al. | 200/38 |
| 3,961,183 | 6/1976 | Dubot et al. | 315/159 |
| 3,979,601 | 9/1976 | Franklin | 307/141 |
| 4,020,358 | 4/1977 | Wyland | 307/141 |
| 4,025,804 | 5/1977 | Bickard | 307/141 |
| 4,209,728 | 6/1980 | Membreno | 315/159 |
| 4,370,565 | 1/1983 | Hayden | 307/141 |
| 4,451,763 | 5/1984 | Sodini | 315/159 |

*Primary Examiner*—Vit W. Miska

*Attorney, Agent, or Firm*—Andrus, Sceales, Starke & Sawall

[57] ABSTRACT

A time switch for controlling the supply of electricity from an electricity source to an electrical load is provided with an auxiliary actuator means for controlling the supply of electricity to the electrical load independent of the time switch. The time switch includes one or more switch contacts and cam which control the position of the switch contacts in response to a timing mechanism. The auxiliary actuator mechanism includes a solenoid mounted directly to the time switch, with a linkage interposed between the solenoid and one or more cams operable independent of the time switch cams to control the position of the switch contacts independent of the time switch. In one embodiment, a photoelectric control is provided between the solenoid and the electricity source, to regulate the supply of electricity to the solenoid in response to the presence or absence of a predetermined level of ambient light.

21 Claims, 3 Drawing Sheets

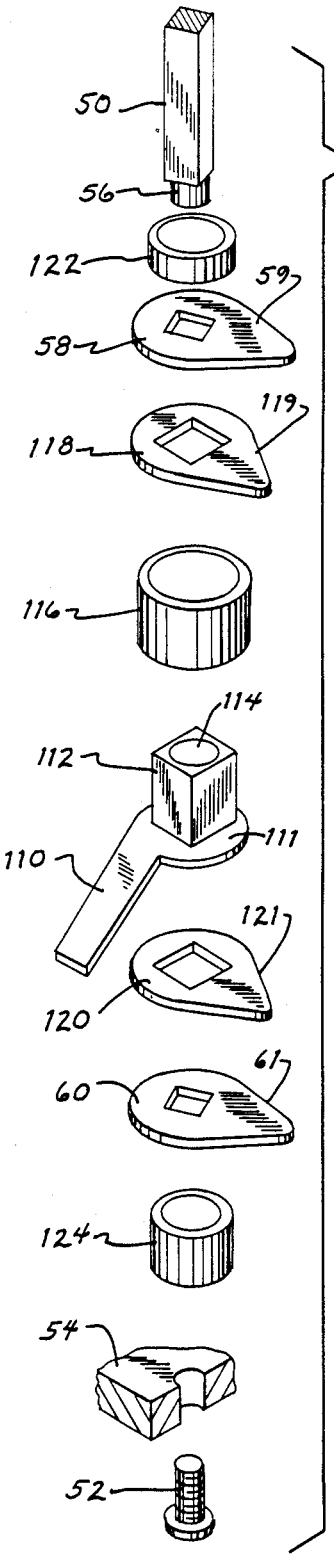
FIG. 6
FIG. 7
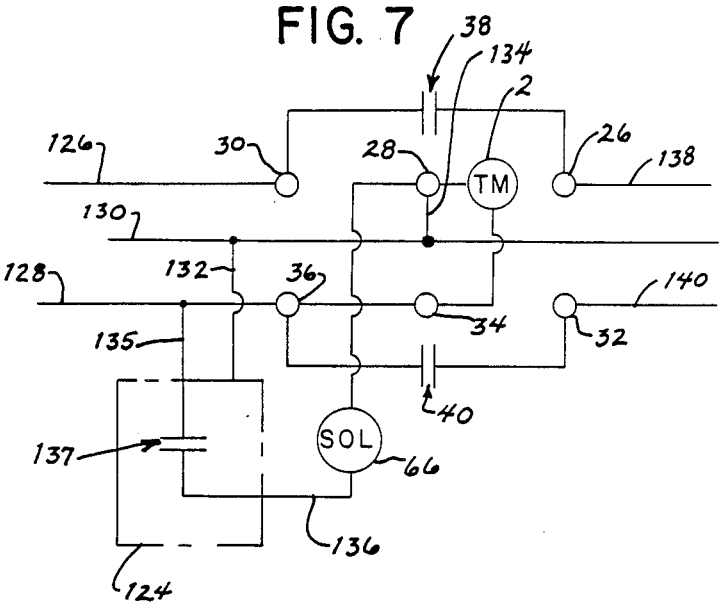
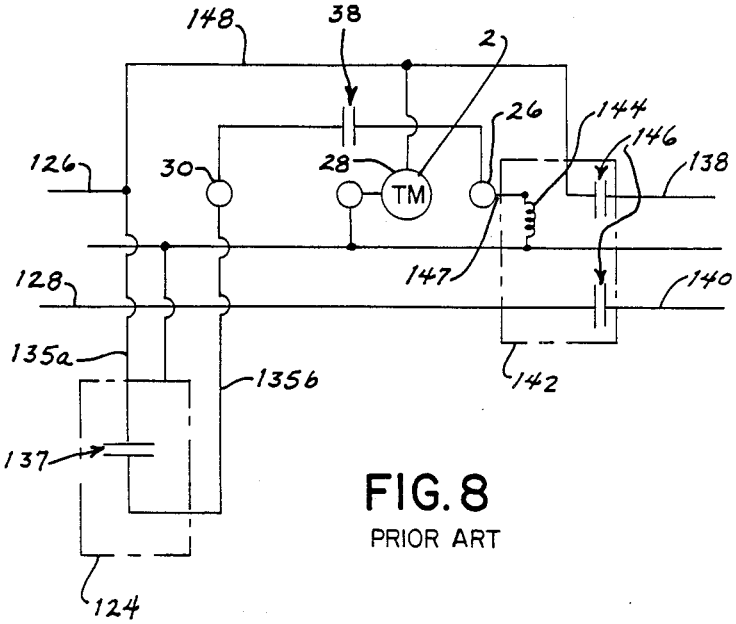
FIG. 8
PRIOR ART

TIMER SWITCH WITH AUXILIARY ACTUATOR

BACKGROUND AND SUMMARY

This invention relates to timed electrical switches, and more particularly to a timed electrical switch for use in a circuit including an auxiliary switching means for controlling the supply of electricity to an electrical load.

An exemplary application of the invention is in an outdoor lighting environment, such as lighting of a sign or billboard. In such a lighting application, it is often desirable to have the billboard illuminated during the times of peak traffic. Such times include the daylight hours, during which artificial illumination is generally unnecessary, as well as a certain number of nighttime hours. For example, the billboard may require illumination from dusk until midnight and from 6:00 a.m. to dawn. It is generally uneconomical to provide illumination from midnight to 6:00 a.m., since traffic is generally low and potential viewers of the billboard too few to justify illumination.

To provide illumination for a billboard according to such a schedule, it is known to use a conventional time switch in combination with a photosensitive switch. However, a photosensitive switch typically is a single-pole switch having a current-carrying capacity much less than that required to power large lighting loads, such as that necessary to illuminate an outdoor billboard. It is also generally the case that such photosensitive controls have a current carrying capacity less than that of a standard double-pole 40 ampere conventional time switch, typically used in such lighting applications. Thus, when controlling large lighting loads, it is necessary to connect the photocontrol so as to control the coil on a relay or contactor. The relay contacts are then sized adequately for the load to be controlled. With such a combination, the photocontrol actuates the coil on the relay or contactor at dusk, thus causing electricity to flow to the lighting to illuminate the billboard. The conventional time switch is typically set to interrupt the supply of electricity at midnight and to restore electricity at 6:00 a.m. At dawn, the photocontrol causes the relay contacts to open, thus turning the lighting off.

A shortcoming of the above-described arrangement is that an auxiliary relay or contactor must be wired into the circuit. Additionally, this configuration provides a duplicity of movable switch contacts for the circuit: one associated with the time switch, and the other associated with the separate relay or contactor.

The present invention is intended to eliminate such shortcomings, and to provide a simple and efficient switching mechanism for lighting and other timed electrical applications. In accordance with the invention, an apparatus for regulating the supply of electricity from an electricity source to an electrical load includes a conventional time switch having a timing mechanism, one or more switch contacts, and switch means responsive to the timing mechanism for selectively connecting and disconnecting the load to and from the electricity source at predetermined times by closing and opening the switch contacts. An auxiliary actuator means, operable independently of the time switch, selectively connects and disconnects the load to and from the power source by closing and opening the same set of switch contacts. The auxiliary actuator means operates in response to an actuator current supplied by a source other than the time switch to provide a supplementary means of connecting the load to the electricity source. In a preferred embodiment, the time switch has one or more switch contacts which are biased toward a closed position. The switch means responsive to the timing mechanism is one or more pivotably mounted cams which, in response to the action of the timing mechanism, bias the contacts away from their normally closed position to open the contacts at predetermined times to disconnect the load from the electricity source. The time switch cams are also responsive to the timing mechanism so as to allow the switch contacts to return to their closed position at a predetermined time in order to reconnect the load to the source. The auxiliary actuator means comprises a solenoid or other electromagnetic device which is movable in response to the flow of a current therethrough. The solenoid is connected to a photosensitive control, which in turn is connected to the electricity source. The photosensitive control allows current to flow from the electricity source to the solenoid in response to detection of an absence of a predetermined level of ambient light in the vicinity of the billboard or other object to be illuminated. The flow of current into the solenoid causes the plunger of the solenoid to withdraw into the cylinder of the solenoid. The plunger of the solenoid is mechanically connected to a linkage, which in turn is mechanically connected to one or more auxiliary switch contact actuating cams which are pivotably mounted alongside the time switch cams. The two sets of cams are movable independently of each other, so that connection of the load to the electricity source can be governed both by the time switch and by the photocontrol via the solenoid. This combination enables an auxiliary photocontrol or other electrical switching means to energize the solenoid, thus closing the switch contacts at a desired point in time, such as dusk. The time switch mechanism then opens the same set of switch contacts according to preselected set times, such as between midnight and 6:00 a.m. At 6:00 a.m., the time switch operates to again close the contacts to reconnect the load. Thereafter, the auxiliary photocontrol cuts off the flow of current to the solenoid at dawn, thus permitting the switch contacts to open to again disconnect the load from the source. This sequence is then repeated at dusk.

The above-referenced construction eliminates the need for a relay or contactor to be wired into the circuit, and also eliminates the separate set of contacts provided by such a mechanism. Actuation of the same set of switch contacts by a time switch and an auxiliary control provides an efficient and compact mechanism for controlling a lighting load.

BRIEF DESCRIPTION OF THE DRAWINGS

The drawings illustrate the best mode presently contemplated of carrying out the invention. In the drawings:

FIG. 6 is an exploded isometric view showing the two sets of independently operable pivotable switch actuating cams;

FIG. 7 is a circuit diagram schematically showing the present invention;

FIG. 8 is a circuit diagram schematically showing a previous auxiliary actuated time switching circuit.

DETAILED DESCRIPTION OF THE PREFERRED EMBODIMENT

Figure 1:
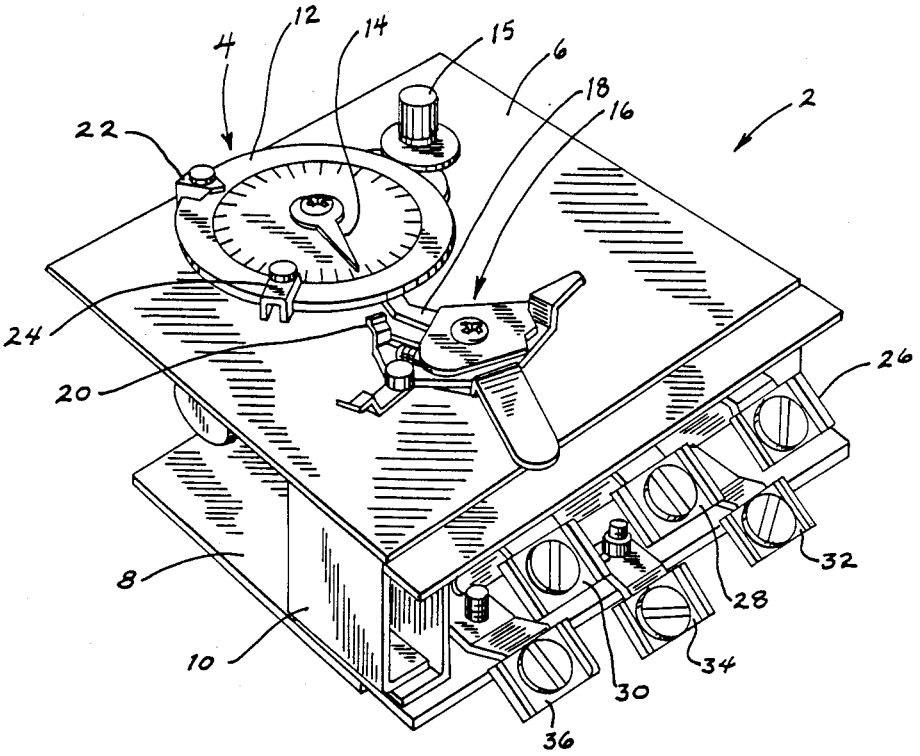
FIG. 1 is an isometric view of a conventional time switch.

As shown in FIG. 1, a conventional timer switch 2 includes a timer 4 mounted to a front plate 6. A rear plate 8 is spaced from front plate 6 and connected thereto by a pair of brackets 10. The timer switch 2 is exemplarily a switch as manufactured under Model No. 525-OSV or Model No. 526 by Reliance Time Controls, Inc. of Racine, Wis. As is well known, time switch 2 is adapted to be connected between an electricity source and an electrical load to regulate the supply of electricity from the source to the load.

Timer 4 includes a timer dial 12 and a time indicator 14. A manual time setter 15 is provided for setting timer dial 12 to the correct time of day. A switching mechanism 16 is mounted to front plate 6. Switch mechanism 16 includes switch actuating arms 18 and 20. Switch actuating arms 18 and 20 are adapted to be engaged by switch trip elements 22 and 24, which are mounted in selected positions on timer dial 12.

Trip elements 22 and 24 are adapted to engage switch actuating arms 18 and 20, respectively, during rotation of timer dial 12. As will be explained in further detail, upon clockwise rotation of timer dial 12, trip element 22 engages switch actuating arm 18 so as to open a set of switch contacts to disconnect an electrical load from a source of electricity. The contacts remain open throughout passage of the time between trip elements 22 and 24. Trip element 24 then engages switch actuating arm 20 at a predetermined time set on timer dial 12, which releases switch actuating arm 20 so as to close the switch contacts to reconnect the load to the electricity source.

Timer switch 2 includes a set of terminals for connection of time switch 2 to leads from an electricity source and from an electrical load. Terminals 26, 28 and 30 are disposed adjacent front plate 6, and terminals 32, 34 and 36 are disposed adjacent rear plate 8. As is well known, terminals 30 and 36 are adapted for connection to lines leading from an electricity source, and terminals 26 and 32 are adapted for connection to lines leading to an electrical load. Terminal 28 is a neutral or ground terminal. Terminal 34 is an incoming hot terminal for the timing motor circuit.

Figure 2:
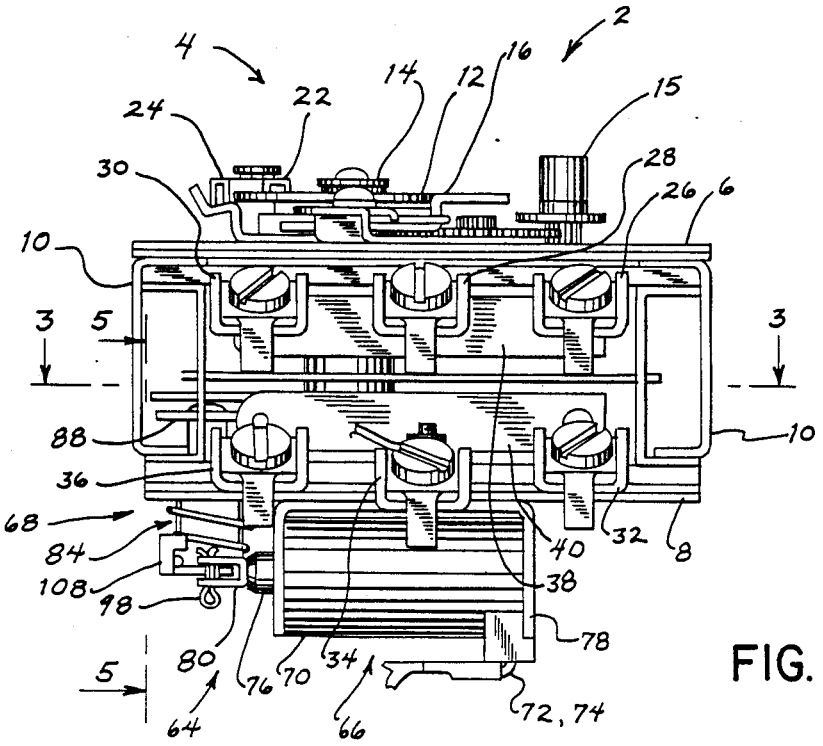
FIG. 2 is a side view of the time switch of FIG. 1, showing the auxiliary solenoid acutator mounted thereunder.
Figure 3:
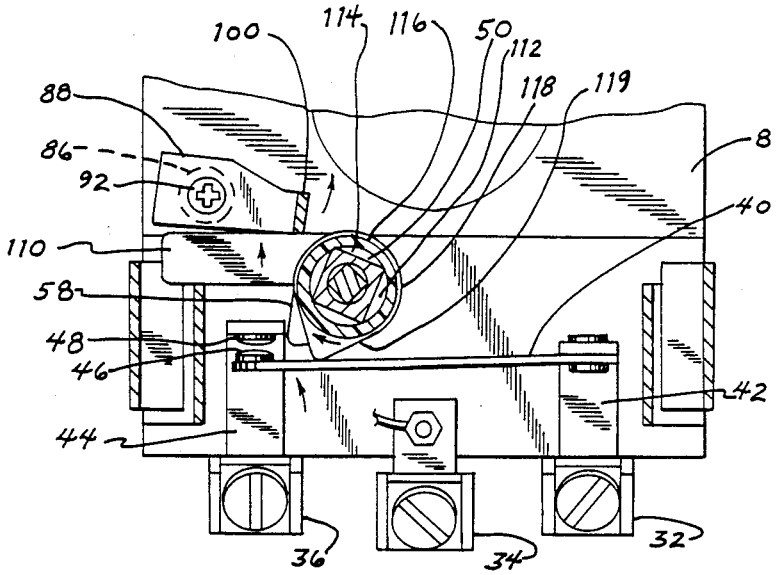
FIG. 3 is a partial sectional view taken generally along line 3—3 of FIG. 2.

With reference to FIG. 2, timer switch 2 includes a pair of switch contact members 38 and 40. As shown in FIG. 3, switch contact member 40 is electrically connected at one end to a base member 42 connected to terminal 32. Contact member 40 spans between base 42 of terminal 32 and a base member 44 of terminal 36. At the end adjacent base 44 of terminal 36, switch contact member 40 is provided with a contact head 46. Base 44 of terminal 36 is provided with a contact head 48. Switch contact member 40 is biased toward a closed position, wherein contact heads 46 and 48 of switch contact member 40 and base 44 of termiral 36 are electrically connected. When in such a closed position, terminal 32 is electrically connected to terminal 36, which allows electricity from an electricity source to flow through terminal 36 to terminal 32 and to thereby reach an electrical load connected to terminal 32.

Switch contact member 38 functions in a manner identical to that of switch contact member 40, being biased toward a closed position for providing an electrical connection between terminals 26 and 30.

Figure 5:
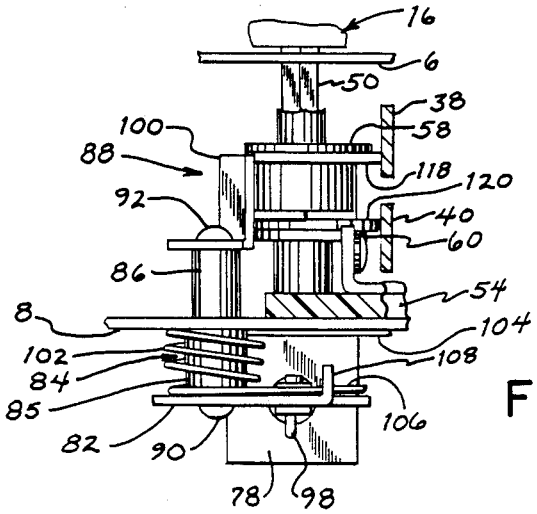
FIG. 5 is a partial sectional view taken generally along line 5—5 of FIG. 2.

A camming mechanism is provided for controlling the position of switch contact members 38 and 40. With reference to FIGS. 5 and 6, a rectangular shaft 50 is connected at one end to switch mechanism 16 Shaft 50 is pivotably mounted between front plate 6 and rear plate 8. One end of shaft 50 is connected to switch mechanism 16, and the other end threadedly connected to a screw 52 adapted for insertion through a hole provided in a plate 54 which engages an internally threaded hub 56 provided on the end of shaft 50. As shown in FIG. 5, plate 54 is adapted for placement adjacent rear plate 8 of timer switch 2. A pair of switch contact actuating cams 58 and 60 have openings adapted to receive and mate with rectangular shaft 50. Cams 58 and 60 have eccentric camming surfaces 59 and 61, respectively, formed thereon.

In response to actuation of switch mechanism 16 by trip elements 22 and 24, shaft 50 rotates cams 58 and 60 so as to control the position of switch contact members 38 and 40. As above mentioned, switch contact members 38 and 40 are biased toward their closed position. Upon engagement of switch actuating arm 18 by trip element 22, shaft 50 is rotated a small amount so as to bring camming surfaces 59 and 61 of cam elements 58 and 60, respectively, into engagement with switch contact members 38 and 40. Such engagement cams switch contact members 38 and 40 away from the contactor heads of terminals 30 and 36, to move switch contact members 38 and 40 to their open position. This movement disconnects the flow of electricity from the electricity source to the electrical load. Switch contact members 38 and 40 will remain in their open position during passage of time between trip elements 22 and 24. Trip element 24 then engages switch actuating arm 20 of switch mechanism 16, which releases switch actuating arm 18 and pivots rectangular shaft 50 to its original position, so that camming surfaces 59 and 61 of cam elements 58 and 60 disengage switch contact members 38 and 40. In this manner, switch contact members 38 and 40 return to their closed position.

The above description details the operation of a conventional timer switch, which it is believed is well known. The present invention incorporates an auxiliary switching mechanism for use in conjunction with the conventional timer switch 2, which will be described hereafter.

As seen in FIG. 2, an auxiliary actuator mechanism is shown at 64. Auxiliary actuator mechanism 64 generally includes a solenoid 66 connected to a linkage mechanism 68. As is well known, solenoid 66 includes a cylinder 70 encasing an internal coil, a pair of external terminals 72, 74 leading to the internal coil, and a plunger 76. Solenoid 66 is of well-known construction; a typical solenoid useful in the invention is number 53679-94, C15 manufactured by Deltrol Controls of Milwaukee, Wis. Solenoid 66 is mounted to rear plate 8 by means of a mounting bracket 78.

Figure 4:
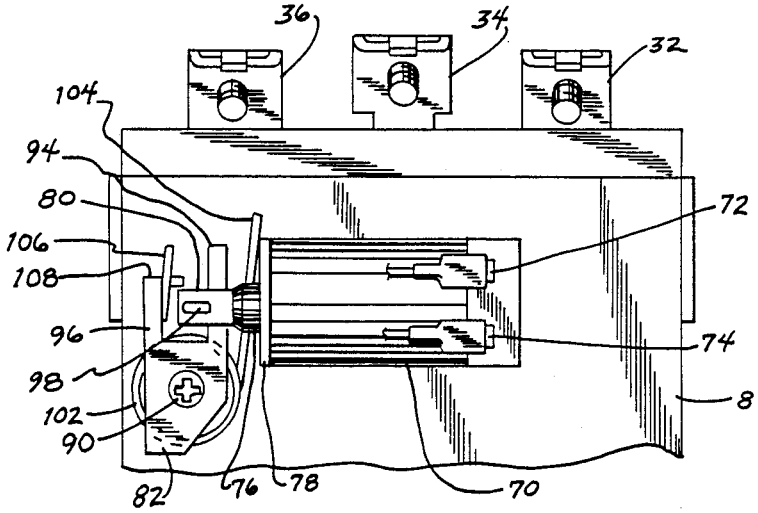
FIG. 4 is a partial bottom view of the time switch of FIGS. 1 and 2, showing the solenoid mounted thereon.

With reference to FIGS. 2 and 4, plunger 76 of solenoid 66 has a U-shaped bracket 80 mounted to its end. As best shown in FIG. 4, an arm 82 is pivotably mounted to a cylindrical post 84 (FIG. 5), which has an increased diameter portion 85 extending outwardly away from rear plate 8 and a reduced diameter portion 86 extending inwardly from rear plate 8 toward front plate 6.

A trigger member 88 (FIG. 5) is connected to the inner end of post 84 at the end of reduced diameter portion 86. A rectangular shaft (not shown) extends within the interior of cylindrical post 84 and projects a small amount from each end thereof. Arm 82 and trigger member 88 are each provided with a rectangular opening to accommodate the projecting portions of the rectangular shaft extending through post 84 and to mate therewith. Arm 82 and trigger member 88 are secured to the shaft extending through post 84 by means of threaded fasteners 90, 92, respectively. Threaded fasteners 90, 92 mate with internal threaded portions provided in the ends of the rectangular shaft member extending through post 84. In this manner, arm 82 and trigger member 88 are interlocked for simultaneous pivotal movement about post 84.

With reference to FIG. 4, arm 82 is provided with a pair of fingers 94, 96 extending therefrom. Finger 94 of arm 82 extends between the upstanding legs of U-shaped bracket 80 connected to the end of solenoid plunger 76. Finger 94 is interconnected to U-shaped bracket 80 by means of a cotter pin 98 extending between the upstanding legs of U-shaped bracket 80. In this manner, arm 82 is caused to pivot about post 84 in response to the action of solenoid plunger 76. Because of the interlocking of arm 82 and trigger member 88, such pivotal movement of arm 82 is transferred via the rectangular shaft passing through the interior of post 84 to trigger member 88, which is provided with a laterally extending portion 100.

As shown in FIGS. 4 and 5, a torsion spring 102 having extending legs 104, 106 is provided about enlarged portion 85 of post 84. Legs 104, 106 of torsion spring 102 bear against solenoid mounting bracket 78 and a downturned hook portion 108 formed at the end of finger 96. This construction provides a counterclockwise bias for arm 82 about post 84 due to the action of torsion spring 102. Such a biasing force tends to pull solenoid plunger 76 outwardly with respect to solenoid cylinder 70.

With reference to FIG. 3, it is seen that laterally extending portion 100 of trigger member 88 contacts a lever member 110, which is pivotably mounted about shaft 50 of timer switch 2. As mentioned previously, shaft 50 controls the action of cams 58, 60 in response to trigger mechanism 16, to control the position of switch contacts 38, 40. As seen in FIG. 6, lever member 110 has a base portion 111, which has a rectangular projection 112 extending therefrom. A circular passage 114 extends through rectangular projection 112. A similarly shaped projection extends from the side of base portion 111 of lever member 110 not shown in FIG. 6, but not to the extent of rectangular projection 112. A cylindrical sleeve 116 is adapted for placement over rectangular projection 112 to butt up against base portion 111. Sleeve 116 extends slightly less than the full length of rectangular projection 112, to thereby leave a portion of rectangular projection 112 extending beyond the end of sleeve 116.

A pair of auxiliary switch contact actuating cams 118, 120 are provided with rectangular passages therethrough. The rectangular passage through cam 118 is adapted to mate with the portion of rectangular projection 112 extending beyond sleeve 116. The rectangular passage through cam 120 mates with the rectangular projection on the side of base portion 111 not shown. Cams 118, 120 are provided with camming surfaces 119, 121, respectively.

Spacer cylinders 122 and 124 are provided adjacent time switch actuated cams 58 and 60, to space the cam assembly away from front and rear plates 6 and 8, respectively.

As shown in FIG. 3, shaft 50 of time switch 2 passes through and rotates freely within circular passage 114 of lever member 110, so that rotation of shaft 50 causes no resultant rotation of lever member FIG. 3 shows switch contact 40 cammed to its open position by the action of camming surface 119 of auxiliary actuating cam 118. When so actuated by auxiliary switching mechanism 64, switch contact 40 attains its open position when solenoid 66 is deenergized so that solenoid plunger 76 is not withdrawn into solenoid cylinder 70. Upon such deenergization of solenoid 66, plunger 76 moves outwardly from cylinder 70 and arm 82 is caused to rotate counterclockwise with respect to post 84 (FIG. 4). Such counterclockwise rotation of arm 82 causes trigger member 88 to rotate clockwise (FIG. 3) and to thereby depress lever member 110. This action causes camming of switch contact members 38, 40 to their open position by means of the action of camming surfaces 119, 121 of cam members 118, 120, respectively.

When solenoid 66 is energized, plunger 76 is withdrawn into cylinder 70, thus causing clockwise rotation of arm 82 (FIG. 4) and counterclockwise rotation of trigger member 88 (FIG. 3). Such action releases pressure exerted on lever member 110 by laterally extending portion 100 of trigger member 88. This release of pressure allows the switch contacts 38, 40 to move to their closed position by means of their bias toward such position. This action is indicated by the arrows shown in FIG. 3.

The above-described construction of the camming assembly provides a mechanism for controlling the position of switch contact members 38 and 40 in response to two separate and independent cam actuating mechanisms. One actuating mechanism is provided by time switch 2, which actuates cams 58 and 60 via rectangular shaft 50. The other switch contact actuating mechanism is auxiliary actuator 64 which, through linkage assembly 68, including U-shaped bracket 80, arm 82, trigger member 88 and lever member 110, controls switch contact actuating cams 118 and 120, independent of the action of time switch shaft 50. Likewise, time switch shaft 50 operates switch contact actuating cams 58 and 60 independent of the action of auxiliary switch contact actuating cams 118 and 120.

Any suitable means may be used to supply current to solenoid 66. In the preferred embodiment, the means for supplying a current to solenoid 66 is a photosensitive control, shown schematically in FIG. 7 at 124. As also shown in FIG. 7, a pair of lines 126, 128 are connected between terminals 30, 36 of timer switch 2 and a source of electricity (not shown). A neutral line 130 runs between the lead lines 126, 128, and is connected to photo control 124 by a lead 132 and to terminal 28 by a lead 134. A line 135 connects photosensitive control 124 to line 128, and a line 136 connects photosensitive control 124 to solenoid 66.

Photosensitive control 124 may be any satisfactory photosensitive mechanism incorporating a photocell and a switching means. In one embodiment, a photocell is used in conjunction with temperature sensitive bimetal switch, shown at 137. Photosensitive controls used in connection with the invention include catalog No. 6241A and 6241B manufactured by Fisher Pierce Div. of Sigma Instruments, Inc. of Braintree, Mass., or catalog No. AT-15, AA-105 manufactured by A. L. R., Inc. of Hackettstown, N.J. With this type of photosensitive control, when photo control 124 is exposed to sunlight the photocell allows current to flow to a bimetal strip associated with a pair of contacts. The current heats the bimetal strip to open the contacts associated therewith, as is well known. When the contacts of switch 137 are open, as during daylight hours, current from line 135 is prevented from passing through photosensitive control 124. When a certain predetermined level of ambient light is absent, such as at dusk, the resistance of photosensitive control 124 increases, thereby preventing enough current to flow to sufficiently heat the bimetal strip. At this time, the bimetal switch 137 closes its contacts and allows current to flow from line 135 through photosensitive control 124 and line 136 to solenoid 66. In this manner, current flowing to solenoid 66 causes plunger 76 to withdraw into cylinder 70, which closes switch contacts 38, 40 as above described.

In the circuit described, the solenoid is typically energized at dusk, when ambient light is insuffient to keep the contacts of switch 136 associated with photosensitive control 124 open. Plunger 76 of solenoid 66 is withdrawn, thus closing switch contacts 38 and 40 and allowing current to flow from terminals 30, 36 to terminals 26, 32, respectively and to lines 138, 140 leading to an electrical load (not shown), such as lighting.

To describe the light sequence, timer switch 2 then operates to cam switch contacts 38, 40 to their open position and disconnect the load at a predetermined time, such as midnight, corresponding to low traffic. At a second predetermined time corresponding to an increase in traffic, such as 6:00 a.m., the camming of switch contacts 38, 40 to their open position by timer switch 2 is discontinued, and contacts 38, 40 are allowed to move to their closed position to reconnect the lighting load.

All the while, plunger 76 of solenoid 66 remains withdrawn within cylinder 70, so that the auxiliary switch contact actuating cams 118, 120 are in a position which allow the closing of switch contacts 38, 40 by timer switch 2. Thus, when timer switch cams 58, 60 are pivoted in response to passage of trip element 24 past switch actuating arms 18 and 20, supply of electricity to the electrical load is resumed. At dawn, when a predetermined level of ambient light reaches photosensitive control 124, the switch 137 associated therewith is activated so as to open the switch contacts and prevent the passage of current through photosensitive control 124 to solenoid 66. When this happens, the electromagnetic force tending to hold plunger 76 within cylinder 70 of solenoid 66 is terminated, thus allowing plunger 76 to be withdrawn from cylinder 70 by means of torsion spring 102 and arm 82. This action, as described above, causes auxiliary switch contact actuating cams 118, 120 to bias switch contacts 38, 40 to their open position, thus terminating the supply of current and disconnecting the electrical load from the electricity source.

FIG. 8 shows a prior circuit for achieving a similar result as that to which the invention is directed. Where possible, like reference characters will be used to denote similar elements as in the present invention, to facilitate clarity. In the previous system of FIG. 8, a trip element is provided on timer switch 2 to close switch contact element 38 at a predetermined time prior to dusk, such as at 6:00 a.m. This provides for morning lighting when dawn is after 6:00 a.m. The time switch then remains on throughout the day. A photosensitive control 124 governs the flow of current from line 126 through lines **135*a* and 135*b* to terminal 30, connected through switch contact 38 to terminal 26. A contactor or relay 142, having a coil 144 and a pair of contacts 146, is connected to terminal 26 by a line 147, and to line 126 by a line 148. When the contacts of switch 137 associated with photosensitive control 124 are open, current is not allowed to pass through photosensitive control 124 to relay 142. As described above, this occurs when a sufficient amount of ambient light is present in the vicinity of photosensitive control 124 to cause switch 137 to remain open, such as during the daylight hours. When adequate ambient light is not present, such as at dusk, the contacts of switch 137 close and current is allowed to flow through photosensitive control 124 to relay 142 through switch contact 38, where the current acts on coil 144 to cause contacts 146 to close. Such action, of course, allows current to flow through relay 142 to lines 138, 140 to an electrical load, such as lighting (not shown). Contacts 146 of relay 142 remain closed during the dark hours, to allow current to pass to the electrical load. However, during a predetermined time interval the action of timer switch 2 interrupts the flow of current to the load, such as between midnight and 6:00 a.m. When a sufficient ambient light is present, the contacts of switch 137 of photosensitive control 124 open, to interrupt the flow of current to relay 142** and to disconnect the load from the electricity source.

It can be seen that the present invention eliminates contacts 146 of relay 142, as well as the necessity of a separate element such as relay 142.

While the present invention has been described with reference to a photosensitive control for providing current to an auxiliary switching mechanism, it is understood that any means for supplying a current to an auxiliary means for actuating the switch contacts of a timer switch is contemplated by the invention.

It is recognized that various alternatives and modifications are contemplated as being within the scope of the following claims particularly pointing and distinctly claiming the subject matter regarded as the invention.

We claim:

1. An apparatus for regulating the supply of electricity from an electricity source to an electrical load, comprising:

a time switch including a timing mechanism, one or more switch contacts, and first switch means operable on said switch contacts, said first switch means being responsive to said timing mechanism for selectively connecting and disconnecting said load to and from said electricity source at predetermined times by selectively closing and opening said switch contacts; and auxiliary actuator means including second switch means operable on said switch contacts, said auxiliary actuator means including linkage means interconnected with said second swtich means and being responsive to an actuating stimulus independent of said time switch for selectively connecting and disconnecting said load to and from said electrically source by closing and opening said switch contacts independent of the closing and opening of said switch contacts by said first switch means of said time switch, to provide a supplementary means of connecting and disconnecting said load to and from said electricity source.

2. The invention according to claim 1, wherein said second switch means of said auxiliary actuator means is operable in response to supply of an electrical current from a source independent of said time switch.

3. The invention according to claim 2, wherein said supply of electrical current to said auxiliary actuator means is controlled by photosensitive means for detecting the presence or absence of a predetermined level of ambient light and for controlling the supply of electrical current to said auxiliary actuator means in response thereto.

4. The invention according to claim 3, wherein said photosensitive means permits a continuous electrical current to flow to said auxiliary actuator means in response to the absence of a predetermined level of light and cuts off the flow of said current to said auxiliary actuator means in response to detection of the presence of a predetermined level of light.

5. The invention according to claim 3, wherein said photosensitive means comprises a photoelectric control connected to said electricity source and to said auxiliary actuator means, said photoelectric control including a photosensitive cell and switch means operably connected thereto, and wherein said photoelectric control allows current to flow from said electricity source to said auxiliary actuator means when said photosensitive cell detects the absence of a predetermined level of light.

6. The invention according to claim 1, wherein said linkage means of said auxiliary actuator means is interconnected with an electromagnetic actuator mechanism having a movable element responsive to the flow of electrical current into said electromagnetic mechanism, said linkage means being responsive to said electromagnetic actuator mechanism so as to selectively actuate said second switch means of said auxiliary actuator means for openng and closing said switch contacts in response to the action of said movable element.

7. The invention according to claim 6, wherein said electromagnetic actuator mechanism comprises a solenoid having a movable plunger responsive to the flow of electrical current into said solenoid.

8. The invention according to claim 7, wherein said solenoid is mounted directly to said time switch.

9. An apparatus for regulating the supply of electricity from an electricity source to an electrical load, comprising:

a time switch including a timing mechanism, one or more switch contacts, and switch means responsive to said timing mechanism for selectively connecting and disconnecting said load to and from said electricity source at predetermined times by selectively closing and opening said switch contacts; and auxiliary actuator means operable independently of said time switch for selectively connecting and disconnecting said load to and from said electricity source by closing and opening said switch contacts at times independent of said predetermined times of said time switch to provide a supplementary means of connecting said load to said electricity source, said auxiliary actuator means comprising:

an auxiliary actuator switch means for closing and opening said switch contacts independent of said switch means of said time switch;

a solenoid having a movable plunger responsive to the flow of electrical current into said solenoid, and linkage means interposed between said solenoid plunger and said auxiliary actuator switch means for closing and opening said switch contacts in response to the action of said solenoid plunger.

10. The invention according to claim 9, wherein said switch contacts are biased to their closed position and said switch means responsive to said timing mechanism comprises one or more first pivotably mounted cam means for selectively camming said switch contacts to their open position in response to said timing mechanism, and wherein said auxiliary actuator switch means comprises one or more second pivotably mounted cam means responsive to said linkage means for selectively camming said switch contacts to their open position in response to the action of said solenoid plunger.

11. The invention according to claim 10, wherein said one or more first and second pivotably mounted cam means are mounted for independent pivotable movement about a common shaft mounted on said time switch.

12. An apparatus for regulating the supply of electricity from an electricity source to an electrical load, comprising:

a time switch including a timing mechanism, one or more switch contacts, and switch means responsive to said timing mechanism for selectively connecting and disconnecting said load to and from said power source at predetermined times by closing and opening said switch contacts, said switch means comprising pivotably mounted cam means for selectively camming said switch contacts to their open position in response to said timing mechanism;

a solenoid mounted directly to said time switch, said solenoid having a movable plunger operable in response to an electrical current supplied thereto;

linkage means interposed between said solenoid plunger and one or more second pivotably mounted cam means for selectively camming said switch contacts to their open position in response to the action of said solenoid plunger; and a photosensitive control connected between said power source and said solenoid, said photosensitive control selectively controlling the flow of electrical current from said electricity source to said solenoid in response to detection of the presence or absence of a predetermined level of light.

13. In a time switch for regulating the supply of electricity from an electricity source to an electrical load, said time switch including a timing mechanism, one or more switch contacts, and first switch means operable on said switch contacts, said first switch means being responsive to said timing mechanism for selectively connecting and disconnecting said load to and from said power source at predetermined times by selectively closing and opening said switch contacts, the improvement comprising auxiliary actuator means including second switch means operable on said switch contacts, said auxiliary actuator means including linkage means interconnected with said second switch means and being responsive to an actuating stimulus independent of said time switch for selectively connecting and disconnecting said load to and from said electricity source by closing and opening said switch contacts independent of the closing and opening of said switch contacts by said first switch means of said time switch to provide a supplementary means of said time switch to provide a supplementary means of connecting and disconnecting said load to and from said power source.

14. The invention according to claim 13, wherein an actuator current is supplied to said auxiliary actuator means in response to the operation of a light sensitive photoelectric control, which permits said actuator current to flow to said auxiliary actuator means in response to detection of the absence of a predetermined level of light and which cuts off the flow of said actuator current to said auxiliary actuator means in response to detection of the presence of a predetermined level of light.

15. The invention according to claim 13, wherein said auxiliary actuator means comprises:

a solenoid mounted to said time switch, said solenoid having a plunger movable in response to supply of an electrical current to said solenoid, said linkage means being interconnected with said solenoid plunger; and said linkage means being responsive to said movable solenoid plunger so as to selectively actuate said second switch means of said auxiliary actuator means for opening and closing said switch contacts in response to the action of said solenoid plunger.

16. In a time switch for regulating the supply of electricity from an electricity source to an electrical load, said time switch including a timing mechanism, one or more switch contacts, and switch means responsive to said timing mechanism for selectively connecting and disconnecting said load to and from said power source at predetermined times by closing and opening said switch contacts, an auxiliary actuator means operable independently of said time switch for selectively connecting and disconnecting said load to and from said electricity source at times independent of said predetermined times of said time switch to provide a supplementary means of connecting said load to said power source, said auxiliary actuator means comprising:

a solenoid mounted to said time switch, said solenoid having a plunger movable in response to supply of an electrical current to said solenoid;

an auxiliary actuator switch means for closing and opening said switch contacts independent of said switch contacts of said time switch; and linkage means interposed between said solenoid and said auxiliary actuator switch means for closing and opening said switch contacts in response to the action of said solenoid plunger independent of the action of said time switch.

17. An outdoor lighting system, comprising:

a luminaire connected to a time switch, said time switch including a timing mechanism, one or more switch contacts, and first switch means operable on said switch contacts, said first switch means being responsive to said timing mechanism for selectively connecting and disconnecting said luminaire to and from a source of electricity at predetermined times by selectively closing and opening said switch contacts;

auxiliary actuator means including second switch means operable on said switch contacts, said auxiliary actuator means including linkage means interconnected with said second switch means and being responsive to an actuating stimulus independent of said time switch for selectively connecting and disconnecting said luminaire to and from said source of electricity by closing and opening said switch contacts independent of the closing and opening of said switch contacts by said first switch means of said time switch; and photosensitive means for supplying the stimulus to said auxiliary actuator means by controlling the supply of an actuator current to said auxiliary actuator means in response to detection of the presence or absence of a predetermined level of light in the vicinity of said luminaire.

18. The invention according to claim 17, wherein said photosensitive means comprises a photoelectric control connected between said electricity source and said auxiliary actuator means, said photoelectric control allowing electricity to flow from said electricity source to said auxiliary actuator means in response to detection of an absence of a predetermined level of light in the vicinity of said luminaire.

19. The invention according to claim 17, wherein said auxiliary actuator means includes a solenoid connected to said photosensitive means, said solenoid having a plunger movable in response to an electrical current supplied to said solenoid, and said linkage means includes means responsive to said movable solenoid plunger for opening and closing said switch contacts in response to the movement of said solenoid plunger.

20. An outdoor lighting system, comprising:

a luminaire connected to a time switch, said time switch including a timing mechanism, one or more switch contacts, and switch means responsive to said timing mechanism for selectively connecting and disconnecting said luminaire to and from a source of electricity at predetermined times by closing and opening said switch contacts;

auxiliary actuator means operable independently of said time switch for selectively connecting and disconnecting said luminaire to and from said source of electricity by closing and opening said switch contacts at times independent of said predetermined times of said time switch, said auxiliary actuator means comprising a solenoid connected to said photosensitive means, said solenoid having a plunger movable in response to an electrical current supplied to said solenoid, an auxiliary actuator switch means for closing and opening said switch contacts independent of said switch means of said time switch, and linkage means interposed between said solenoid and said auxiliary actuator switch means for closing and opening said switch contacts in response to the movement of said solenoid plunger; and photosensitive means for controlling the supply of an actuator current to said auxiliary actuator means in response to detection of the presence or absence of a predetermined level of light in the vicinity of said luminaire.

21. The invention according to claim 20, wherein said auxiliary actuator switch means comprises one or more pivotably mounted cams actuable by said linkage means for selectively opening and closing said switch contacts in response to the action of said solenoid plunger independent of said time switch.

* * * * *